US006016587A

United States Patent [19]

Savitt et al.

[11] Patent Number: 6,016,587

[45] Date of Patent: Jan. 25, 2000

[54] TOOTHBRUSH

[75] Inventors: Jonathan Alan Savitt, London; Charles Edward Taylor, Truro, both of United Kingdom

[73] Assignee: Mariax Limited, London, United Kingdom

[21] Appl. No.: 09/000,399

[22] PCT Filed: Jul. 26, 1996

[86] PCT No.: PCT/GB96/01797

§ 371 Date: Apr. 10, 1998

§ 102(e) Date: Apr. 10, 1998

[87] PCT Pub. No.: WO97/04686

PCT Pub. Date: Feb. 13, 1997

[30] Foreign Application Priority Data

Jul. 28, 1995 [GB] United Kingdom ..... 9515596

[51] Int. Cl.[7] ..... A47L 9/04

[52] U.S. Cl. ..... 15/167.1; 15/205.2

[58] Field of Search ..... 15/171, 167.1, 15/159.1, 160, 205.2, 207.2

[56] References Cited

U.S. PATENT DOCUMENTS

| | | | |
|---|---|---|---|
| D. 253,321 | 11/1979 | Saute . | |
| 381,749 | 4/1888 | Ashburner . | |
| 457,007 | 8/1891 | Osborn | 15/205.2 |
| 800,422 | 9/1905 | White | 15/205.2 |
| 1,617,569 | 2/1927 | Boyle . | |
| 2,064,860 | 12/1936 | Sekine | 15/167.1 |
| 2,516,778 | 7/1950 | Kreidenweiss . | |
| 2,582,552 | 1/1952 | Marco | 15/167.1 |
| 5,297,884 | 3/1994 | Cubillas . | |
| 5,749,116 | 5/1998 | Wieder | 15/160 |
| 5,806,127 | 9/1998 | Samoil et al. . | |
| 5,836,036 | 11/1998 | Ivory | 15/167.1 |

FOREIGN PATENT DOCUMENTS

| | | |
|---|---|---|
| 357926 | 1/1906 | France . |
| 813990 | 5/1950 | Germany . |
| 07322917 | 12/1995 | Japan . |

*Primary Examiner*—Terrence R. Till
*Assistant Examiner*—Jennifer McNeil
*Attorney, Agent, or Firm*—Nixon Peabody LLP; Grant E. Pollack

[57] ABSTRACT

A toothbrush having a handle portion and a working, head portion from which a plurality of bristles extend, the bristles being arranged in tufts. The head portion is provided with at least one through-hole extending from the rear to the front surface thereof and terminating among the tufts. The edge of the through-hole is profiled to provide a restriction between the rear and front surfaces, whereby the cleansing effect of running water entering the through-hole towards the tufts, to wash debris out of the bristles from the base thereof, is enhanced by a venturi effect. The tufts adjacent the through-hole or holes may be angled inwardly to enhance the cleaning effect and to provide a more evenly-spaced array of bristle tips.

5 Claims, 2 Drawing Sheets

TOOTHBRUSH

DISCLOSURE OF THE INVENTION

The present invention relates generally to devices for oral hygiene and, more particularly, to a toothbrush which can be cleaned more effectively than existing toothbrushes.

Conventional research and literature on dental hygiene has focused on the removal of dental plaque and food debris from teeth using a toothbrush, while relatively little attention has been given to the cleaning of toothbrushes after use.

Only in the era prior to the advent of the modern plastics bristle, where natural products were the only materials available, was special advice given. This concentrated on the importance of carefully drying the bristles after use, usually for about 24 hours for the natural bristle to regain its rigidity. Since the universal adoption of the modern toothbrush having multi-filament tufted plastic bristles, for example nylon, no specific advice for its cleaning has been given; any advice concentrating on toothbrush techniques in the mouth, and latterly the exact amounts of toothpaste to avoid over-dosing with fluoride.

Some early proposals for synthetic brushes, before nylon bristles became available, did however give rise to their own specific cleaning problems. One such brush is described in GB 690422, which proposes a toothbrush having a base member, which may form part of or be attached to a handle, and brushing elements in the form of spines which are formed integrally with the base member by injection molding, the spines being arranged in concentric rings around a central aperture to facilitate cleaning. In practice, it is believed that such toothbrushes were never made on a commercial scale but, as described in GB 690422, the arrangement of the spines, which individually are of semi-circular cross section and of necessity, in order to effect removal from the injection mold, would be thicker at the roots than at the tips, is such as to form a relatively dense or close-packed configuration which, without the aperture, would tend to resist cleaning. With the advent of tufted nylon bristles in the early 1950's, in which the individual bristles are formed from filamentary nylon or other plastics material of much smaller cross sectional area than the spines of GB 690422 and are arranged in tufts or clumps, the base or root ends of which are embedded in holes formed in the head portion of the brush, no cleaning problem was recognized in that the close-packed arrangement of the bristles in each tuft was considered, as was thought to be the case with natural bristles, to resist penetration by foreign matter, while sufficient free volume exists around and between the tufts to allow rinsing water to flush out any debris between or at the roots of the tufts.

It is now recognized that a cleaning problem exists with tufted toothbrushes in that the tufts tend to become splayed out in use, which makes it easier for residues of toothpaste, food and dental plaque to accumulate at the base of the bristles within the tufts and reduce the inter-tuft space, thereby reducing washing efficiency. It has been suggested that, particularly where the toothbrush is kept in a warm, humid environment such as a modern bathroom, microorganisms, particularly those associated with food debris or blood taint, can survive on the toothbrush for several days. Evidently, this is detrimental to oral hygiene particularly where the user already has gingivitis.

Moreover, when the user attempts to clean the brush under a running tap, the force of the water tends to drive the toothpaste residue and the like deeper into the tufts of bristles rather than away from the brush.

It is therefore an object of the present invention to provide a safe, durable, economical toothbrush from which debris, such as the residues of toothpaste, food and dental plaque, can more easily be removed.

In accordance with one aspect of the present invention, there is provided a toothbrush with a handle portion and a working, head portion from which a plurality of bristles extend. The bristles are arranged in tufts and the head portion is provided with at least one through-hole terminating among the tufts, whereby in cleaning after use running water caused to enter the through-hole towards the tufts washes debris out of the bristles from the base thereof. Where the toothbrush has one through-hole, it is preferably formed in the central part of the head and extends from the rear to the front thereof, causing cleaning water to enter the hole from the rear of the head.

According to another aspect of the present invention is a toothbrush having a handle portion and a working, head portion from which a plurality of bristles extend. The bristles are arranged in tufts and the head portion is provided with a through-hole extending from the rear to the front surface thereof and terminating among the tufts. The edge of the through-hole is profiled to provide a restriction between the rear and front surfaces, whereby the cleansing effect of running water, caused to enter the through-hole towards the tufts to wash debris out of the bristles from the base thereof, is enhanced by a venturi effect.

In accordance with a further aspect of the present invention is a method of using a toothbrush having a handle portion and a working, head portion from which a plurality of bristles extend. The bristles are arranged in tufts and the head portion is provided with a through-hole extending from the rear to the front surface thereof and terminating among the tufts. The edge of the through-hole is profiled to provide a restriction between the rear and front surfaces. The method comprises the steps of:

(i) placing toothpaste in proximity to the through-hole of the head portion;

(ii) brushing the user's teeth;

(iii) when brushing is complete, offering the rear of the head portion to running water such that the flow of water runs through the through-hole, and adheres to the profile and along the tufts of the bristles from the roots thereof, to rinse away toothpaste residue, food debris or plaque in or around the tufts.

The above and other features and advantages of the present invention are realized in specific, illustrative embodiments thereof, presented hereinbelow in conjunction with the accompanying drawings, in which.

The same numerals are used throughout the various figures of the drawings to designate similar parts. Still other objects and advantages of the present invention will become apparent from the following description of the preferred embodiments.

Figure 1:
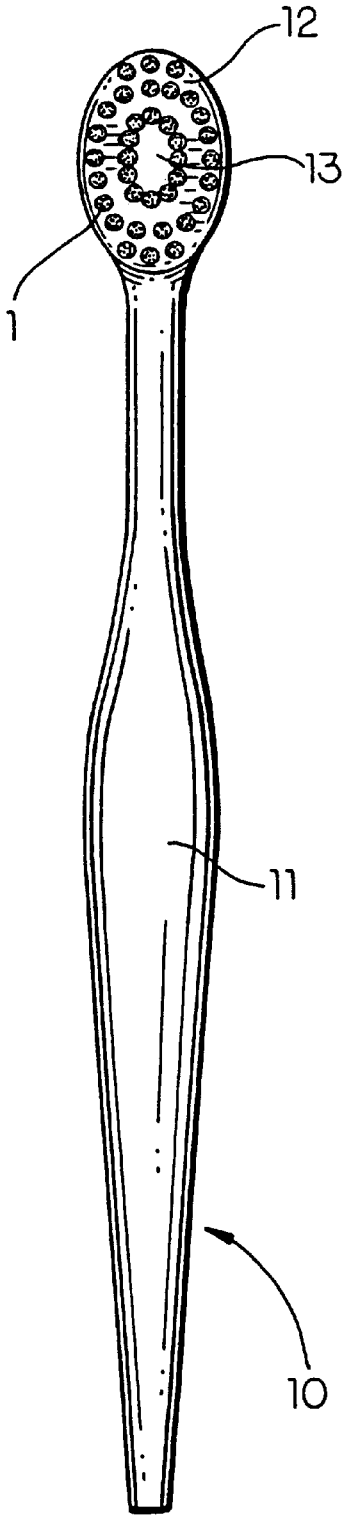
FIG. 1 is a plan view of a toothbrush underside, according to one aspect of the present invention.
Figure 2:
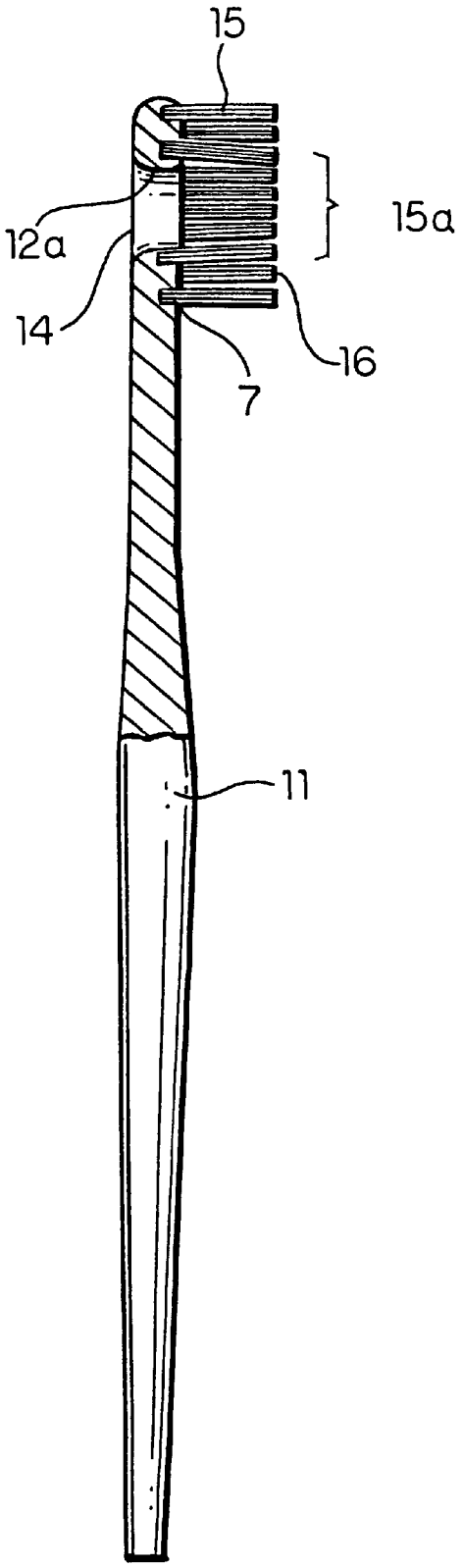
FIG. 2 is a sectional view centrally and longitudinally through the toothbrush of FIG. 1.
Figure 3:
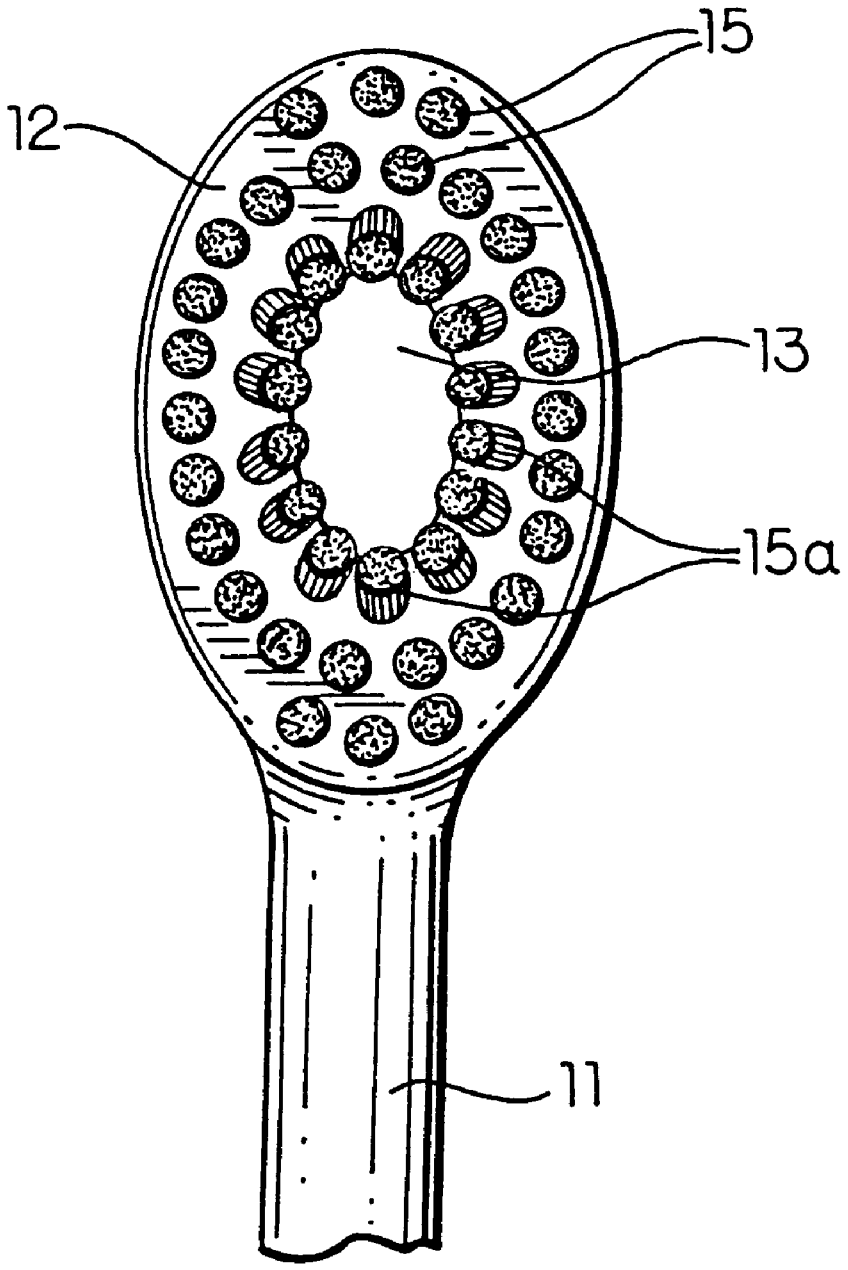
FIG. 3 is an enlarged fragmentary view of the underside of the toothbrush head portion shown in FIG. 1.

Referring now to the drawings and more particularly to FIGS. 1–3, there is shown generally a specific, illustrative toothbrush 10 in accordance with various aspects of the present invention. According to one aspect of the present invention, the toothbrush includes a handle portion 11 and a working head portion 12 with a curved inner profile 12*a* defining a central oval-shaped through-hole 13, extending from the rear or upper surface 14 to the front or lower surface of the head portion 12. Tufts of bristles 15 are attached to the head 12, the bristles having tip portions 16 and root portions 17. The tufts of bristles 15*a* in the inner row are angled inwardly, whereby the tip portions thereof partially occlude or obstruct the edge of the through-hole and are rendered more susceptible to the flushing effect of water flowing through the hole. Channels (not shown) may be provided through or around the head 12 and the tufts of bristles 15, whereby water running on to the head is directed preferentially through the tufts from the roots of the bristles to the tips.

The through-hole or holes may be disposed on a central axis in the head portion, and may have any shape. However, the shape of the through-hole may be such that, in use, water is preferentially directed to the base of the bristles or tufts thereof, thereby improving the efficacy of the removal of debris. For example, the inner profile of the head portion, defining the or each through-hole, may be curved or otherwise profiled to exploit the tendency for water to adhere thereto until it reaches the bristles by surface tension or the Coanda effect. Alternatively or concurrently therewith, the shape of the through-hole may provide channels or other flow pathways to enhance the flushing and cleansing effect of the water, for example by providing a venturi effect when placed in the water stream. The head of the toothbrush may be generally of any shape commonly known for toothbrush heads, for example, rectangular, oval or diamond shaped. At least the tufts immediately adjacent the or each hole may be angled inwardly to provide a more evenly-distributed disposition of bristle tips and to assist in toothpaste and debris flow in at least the inner tufts when washing the toothbrush.

There is a natural tendency arising from the compression of the bristles at the roots thereof for each tuft to splay slightly outward from root to tip, that is, the portions of the tufts which are embedded in the material of the head are narrower than the ends of the tufts which contact the teeth. This tendency becomes more marked with accumulating use of the brush. As a result, liquid which contains saliva, toothpaste and food and plaque residues tends to accumulate not only between the tufts but also within the individual tufts, between the bristles. Toothbrushes according to the present invention, however, are more susceptible to being effectively cleaned of such matter than toothbrushes hitherto available.

In use, toothpaste is placed in hole 13 or on tips 16 of the bristles and the user brushes his or her teeth. When brushing is complete, the user offers the rear 14 of the head 12 to water running from the tap. The flow of water thus runs through the through-hole 13, adhering to profile 12 by virtue of the Coanda effect, and along the tufts of bristles 15 from the roots thereof, thereby rinsing away any toothpaste residue, food debris or plaque retained in or around the tufts of the bristles. The brush may be suspended by the through-hole from a suitable hook for drying and storage until the next use, whereby the damp bristles at the heel of the head are allowed to dry without being in contact with bacteria-laden drainage water, as often occurs when a conventional toothbrush is held in a slotted toothbrush rack, suspended by the bristles.

The through-hole may be loaded with toothpaste either from the front or bristle side or from the rear such that application of toothpaste to the teeth may be effected slowly, thus enabling an approximately predetermined, or at least a limited maximum, charge of toothpaste and hence fluoride to be more evenly delivered to the teeth. This advantageously reduces the tendency with known toothbrushes for some teeth, namely those receiving substantially the whole amount of toothpaste charge, to become more abraded than the remainder, while other teeth receive practically no toothpaste and are thus inadequately cleaned. The head and/or the bristles may be provided with a visual indication of a suitable toothpaste charge volume, or the dimensions of the through-hole may be chosen such that a filling thereof with toothpaste constitutes a particular charge, as recommended by various statutory bodies as containing the desirable quantity of fluoride.

Since from the foregoing the construction and advantages of the invention may be readily understood, further explanation is believed unnecessary. However, since numerous modifications will readily occur to those skilled in the art after consideration of the foregoing specification and accompanying drawings, it is not intended that the invention be limited to the exact construction shown and described, but all suitable modifications and equivalents may be resorted to which fall within the scope of the appended claims.

What is claimed is:

1. A toothbrush having a handle portion and a working head portion from which a plurality of bristles extend, in which the bristles are arranged in tufts and the head portion is provided with a central elongated oval-shaped through-hole, the through-hole extending from the rear to the front surface thereof and terminating among the tufts, the through-hole having an edge between the front and rear surfaces of the head portion, the edge having a continuously curved inner profile defining the oval-shaped through-hole to provide a restriction between the rear and front surfaces, whereby the cleansing effect of running water caused to enter the through-hole towards the tufts to wash debris out of the bristles from the base thereof, is enhanced by a venturi effect.

2. The toothbrush set forth in claim 1 wherein the head portion is rectangular, oval or diamond shaped.

3. The toothbrush set forth in claim 1 wherein at least the tufts adjacent the through-hole are angled inwardly.

4. A method of using a toothbrush having a handle portion and a working, head portion from which a plurality of bristles extend, in which the bristles are arranged in tufts and the head portion is provided with a central elongated oval-shaped through-hole, the through-hole extending from the rear to the front surface thereof and terminating among the tufts, the through-hole having an edge between the front and rear surfaces of the head portion, the edge having a continuously curved inner profile defining the oval-shaped through-hole to provide a restriction between the rear and front surfaces, the method comprising the steps of:

(i) placing toothpaste in proximity to the through-hole of the head portion;

(ii) brushing the user's teeth;

(iii) when brushing is complete, offering the rear of the head portion to running water such that the flow of water runs through the through-hole, and adheres to the profile and along the tufts of the bristles from the roots thereof, to rinse away toothpaste residue, food debris or plaque in or around the tufts.

5. The method set forth in claim 4 further comprising the step of suspending the toothbrush from a hook for drying and storage until the next use, whereby the damp bristles at the heel of the head are allowed to dry without being in contact with bacteria-laden drainage water.

* * * * *